US008840108B2

(12) United States Patent
Morikawa et al.

(10) Patent No.: US 8,840,108 B2
(45) Date of Patent: Sep. 23, 2014

(54) PAPER READING APPARATUS, JAM DETECTION METHOD, AND COMPUTER-READABLE, NON-TRANSITORY MEDIUM

(71) Applicant: PFU Limited, Kahoku (JP)

(72) Inventors: Shuichi Morikawa, Kahoku (JP); Masanobu Hongo, Kahoku (JP); Ryoichi Yasukawa, Kahoku (JP); Takayuki Umi, Kahoku (JP)

(73) Assignee: PFU Limited, Kahoku-shi (JP)

( * ) Notice: Subject to any disclaimer, the term of this patent is extended or adjusted under 35 U.S.C. 154(b) by 0 days.

(21) Appl. No.: 13/962,760

(22) Filed: Aug. 8, 2013

(65) Prior Publication Data

US 2014/0054851 A1 Feb. 27, 2014

(30) Foreign Application Priority Data

Aug. 24, 2012 (JP) ..... 2012-185165

(51) Int. Cl.
*B65H 7/12* (2006.01)
*B65H 5/00* (2006.01)

(52) U.S. Cl.
CPC ..... *B65H 5/00* (2013.01)
USPC ..... 271/263; 271/258.01

(58) Field of Classification Search
USPC ..... 271/263, 258.01
See application file for complete search history.

(56) References Cited

U.S. PATENT DOCUMENTS 6,741,727 B1 * 5/2004 Hirasawa ..... 382/112
7,845,637 B2 12/2010 Shimazaki
8,066,280 B2 11/2011 Simonis et al.
8,091,888 B2 1/2012 Tamamoto
8,266,965 B2 9/2012 Schoen
8,419,014 B2 4/2013 Yamagishi et al.
8,567,777 B2 * 10/2013 Syracuse et al. ..... 271/263
2002/0079644 A1 6/2002 Phinney
2005/0127597 A1 6/2005 Sano et al.

(Continued)

FOREIGN PATENT DOCUMENTS

JP 56-159656 12/1981
JP 57-169767 10/1982

(Continued)

OTHER PUBLICATIONS

Office action mailed Jul. 9, 2013 in JP 2012-185165 including English translation, 6pp.

(Continued)

*Primary Examiner* — Kaitlin Joerger
(74) *Attorney, Agent, or Firm* — Christie, Parker & Hale, LLP

(57) ABSTRACT

There are provided a paper conveying apparatus, a jam detection method and a computer-readable, non-transitory medium which can determine whether a jam has occurred based on the sound which is generated by a paper during conveyance at a low cost. The paper conveying apparatus includes an ultrasonic detector, provided near a conveyance path of a paper, for detecting an ultrasonic wave which passes through paper and outputting an ultrasonic signal, a multifeed detector for determining whether multifeed of papers has occurred based on a component of a first frequency band in the ultrasonic signal, and a sound jam detector for determining whether a jam has occurred based on a component of a second frequency band lower than the first frequency band in the ultrasonic signal.

8 Claims, 14 Drawing Sheets

(56) References Cited

U.S. PATENT DOCUMENTS

| | | | | |
|---|---|---|---|---|
| 2006/0145412 | A1 | 7/2006 | Tagawa et al. | |
| 2008/0224390 | A1 | 9/2008 | Ma et al. | |
| 2011/0278786 | A1* | 11/2011 | Yamagishi et al. | 271/18 |
| 2011/0292459 | A1* | 12/2011 | Murosaki | 358/442 |
| 2012/0019841 | A1* | 1/2012 | Schaertel et al. | 358/1.9 |
| 2012/0235929 | A1* | 9/2012 | Hongo et al. | 345/173 |
| 2013/0093136 | A1 | 4/2013 | Sakharshete et al. | |
| 2013/0140757 | A1 | 6/2013 | Phinney et al. | |
| 2013/0140760 | A1 | 6/2013 | Syracuse et al. | |
| 2013/0300056 | A1 | 11/2013 | Kai | |

FOREIGN PATENT DOCUMENTS

| | | |
|---|---|---|
| JP | 62-117364 | 5/1987 |
| JP | 3-192050 | 8/1991 |
| JP | 04-264462 | 9/1992 |
| JP | 5-24716 | 2/1993 |
| JP | 06-103438 | 4/1994 |
| JP | 2000-182052 | 6/2000 |
| JP | 2000-251108 | 9/2000 |
| JP | 2001-302021 | 10/2001 |
| JP | 2003-212386 | 7/2003 |
| JP | 2006-84595 | 3/2006 |
| JP | 2006-298606 | 11/2006 |
| JP | 2009-161291 | 7/2009 |
| JP | 2010-166442 | 7/2010 |
| JP | 2011-31999 | 2/2011 |
| JP | 2011-37524 | 2/2011 |
| JP | 2011-244091 | 12/2011 |
| JP | 2011-254248 | 12/2011 |
| JP | 2012-131579 | 7/2012 |

OTHER PUBLICATIONS

Office action mailed Jul. 9, 2013 in JP 2012-185247 including English translation, 6pp.

Office action mailed Sep. 24, 2013 in JP 2012-185247 including English translation, 5pp.

Office action mailed Jul. 9, 2013 in JP 2012-185335 including English translation, 6pp.

Office action mailed Jul. 9, 2013 in JP 2012-185404 including English translation, 5pp.

Office action mailed Jul. 9, 2013 in JP 2012-203446 including English translation, 6pp.

Office action mailed Jan. 7, 2014 in JP 2012-185247 including English translation, 4pp.

* cited by examiner

PAPER READING APPARATUS, JAM DETECTION METHOD, AND COMPUTER-READABLE, NON-TRANSITORY MEDIUM

CROSS-REFERENCE TO RELATED APPLICATIONS

This application is based upon and claims the benefit of priority of prior Japanese Patent Application No. 2012-185165, filed on Aug. 24, 2012, the entire contents of which are incorporated herein by reference.

TECHNICAL FIELD

Embodiments discussed in the present specification relate to paper conveying technology.

BACKGROUND

In a paper conveying apparatus of an image reading apparatus, image copying apparatus, etc., sometimes a jam occurs when the paper moves along the conveyance path. In general, a paper conveying apparatus is provided with the function of determining whether a jam has occurred by a paper being conveyed to a predetermined position inside the conveyance path within a predetermined time from the start of conveyance of the paper and of stopping the operation of the apparatus when a jam has occurred.

On the other hand, if a jam occurs, a large sound is generated in the conveyance path, so the paper conveying apparatus can determine whether a jam has occurred based on the sound which is generated on the conveyance path and thereby detect the occurrence of a jam without waiting for the elapse of the predetermined time.

A jam detection device of a copier which converts a sound which is generated on a conveyance path to an electrical signal and determines that a jam has occurred when the time during which a reference level is exceeded exceeds a reference value has been disclosed (see Japanese Laid-Open Patent Publication No. 57-169767).

SUMMARY

To determine whether a jam has occurred by a sound, a dedicated microphone which detects a sound which is generated on a conveyance path is necessary. There was the problem that the cost of the paper conveying apparatus increased.

Accordingly, it is an object of the present invention to provide a paper conveying apparatus, jam detection method that can determine whether a jam has occurred based on the sound which is generated by a paper during conveyance of the paper at a low cost and a computer-readable, non-transitory medium storing a computer program for causing a computer to implement such a jam detection method.

According to an aspect of the apparatus, there is provided a paper conveying apparatus. The paper conveying apparatus includes an ultrasonic detector, provided near a conveyance path of a paper, for detecting an ultrasonic wave which passes through paper and outputting an ultrasonic signal, a multifeed detector for determining whether multifeed of papers has occurred based on a component of a first frequency band in the ultrasonic signal, and a sound jam detector for determining whether a jam has occurred based on a component of a second frequency band lower than the first frequency band in the ultrasonic signal.

According to an aspect of the method, there is provide a jam detection method. The jam detection method includes acquiring an ultrasonic signal corresponding to an ultrasonic wave which passes through paper, determining, by a computer, whether multifeed of papers has occurred based on a component of a first frequency band in the ultrasonic signal, and determining whether a jam has occurred based on a component of a second frequency band lower than the first frequency band in the ultrasonic signal.

According to an aspect of the computer-readable, non-transitory medium storing a computer program, the computer program causes a computer to execute a process, including acquiring an ultrasonic signal corresponding to an ultrasonic wave which passes through paper, determining whether multifeed of papers has occurred based on a component of a first frequency band in the ultrasonic signal, and determining whether a jam has occurred based on a component of a second frequency band lower than the first frequency band in the ultrasonic signal.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

DESCRIPTION OF EMBODIMENTS

Hereinafter, a paper conveying apparatus, jam detection method, and computer program according to an embodiment, will be described with reference to the drawings. However, note that the technical scope of the invention is not limited to these embodiments and extends to the inventions described in the claims and their equivalents.

Figure 1:
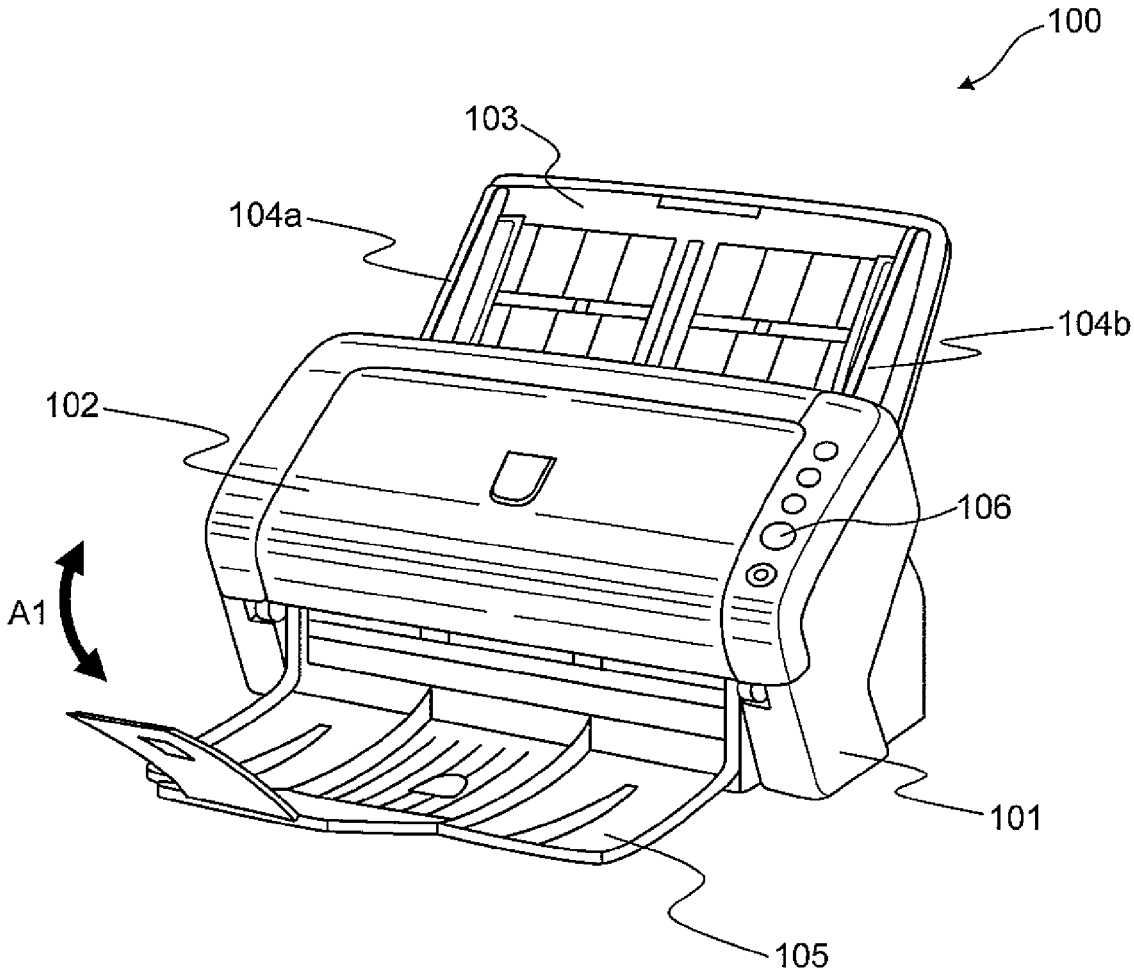
FIG. 1 is a perspective view which shows a paper conveying apparatus 100 according to an embodiment.

FIG. 1 is an example of a perspective view which shows a paper conveying apparatus 100 which is configured as an image scanner, according to an embodiment.

The paper conveying apparatus 100 includes a lower housing 101, an upper housing 102, a paper tray 103, an ejection tray 105, an operation button 106, etc.

The lower housing 101 and the upper housing 102 are formed by plastic material. The upper housing 102 is arranged at a position which covers the top surface of the paper conveying apparatus 100 and is engaged with the lower housing 101 by hinges so as to be able to be opened and closed at the time of a paper jam, at the time of cleaning of the inside of the paper conveying apparatus 100, etc.

The paper tray 103 is engaged with the lower housing 101 in a manner enabling a paper to be placed. The paper tray 103 is provided with side guides 104*a* and 104*b* which can be moved in a direction perpendicular to a conveyance direction of the paper, that is, to the left and right directions from the conveyance direction of the paper. By positioning the side guides 104*a* and 104*b* to match with the width of the paper, it is possible to limit the width direction of the paper.

The ejection tray 105 is engaged with the lower housing 101 by hinges so as to be able to pivot in the direction which is shown by an arrow mark A1. In the opened state as shown in FIG. 1, the ejected paper can be held.

The operation button 106 is arranged on the surface of the upper housing 102. If pushed, it generates and outputs an operation detection signal.

Figure 2:
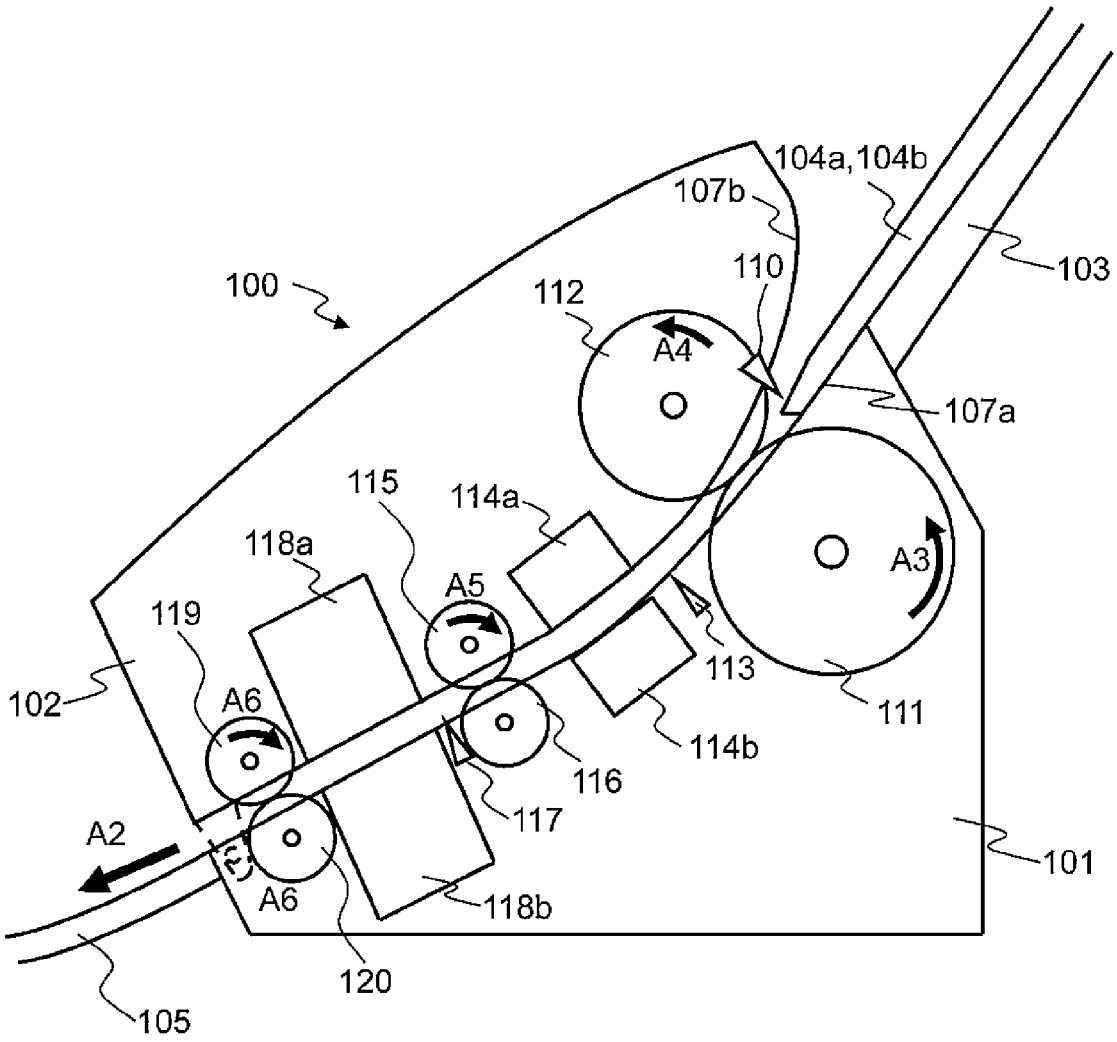
FIG. 2 is a view for explaining an example of a conveyance route at an inside of a paper conveying apparatus 100.

FIG. 2 is an example of a view for explaining the conveyance route at the inside of the paper conveying apparatus 100.

The conveyance route at the inside of the paper conveying apparatus 100 has a first paper detector 110, a paper feed roller 111, a retard roller 112, a second paper detector 113, an ultrasonic transmitter 114*a*, an ultrasonic receiver 114*b*, a first conveyor roller 115, a first driven roller 116, a third paper detector 117, a first image capture unit 118*a*, a second image capture unit 118*b*, a second conveyor roller 119, a second driven roller 120, etc.

The top surface of the lower housing 101 forms the lower guide 107*a* of the conveyance path of the paper, while the bottom surface of the upper housing 102 forms the upper guide 107*b* of the conveyance path of the paper. In FIG. 2, the arrow mark A2 shows the conveyance direction of the paper. Below, "upstream" means upstream of the conveyance direction A2 of the paper, while "downstream" means downstream of the conveyance direction A2 of the paper.

The first paper detector 110 has a contact detection sensor which is arranged at an upstream side of the paper feed roller 111 and the retard roller 112 and detects if a paper is placed on the paper tray 103. The first paper detector 110 generates and outputs a first paper detection signal which changes in signal value between a state in which a paper is placed on the paper tray 103 and a state in which one is not placed.

The second paper detector 113 has a contact detection sensor which is arranged at a downstream side of the paper feed roller 111 and the retard roller 112 and at an upstream side of the first conveyor roller 115 and first driven roller 116 and detects if there is a paper present at that position. The second paper detector 113 generates and outputs a second paper detection signal which changes in signal value between a state at which there is a paper at that position and a state where there is no paper there.

The ultrasonic transmitter 114*a* and the ultrasonic receiver 114*b* are an example of an ultrasonic detector, and are arranged near the conveyance path of the paper so as to face each other across the conveyance path. The ultrasonic transmitter 114*a* transmits an ultrasonic wave at a predetermined timing. Note that, the reason why the ultrasonic transmitter 114*a* transmits an ultrasonic wave at a predetermined timing (at predetermined intervals) is to prevent the ultrasonic transmitter 114*a* from being affected by waves reflected by the paper. The ultrasonic transmitter 114*a* transmits an ultrasonic wave. On the other hand, the ultrasonic receiver 114*b* detects an ultrasonic wave which is transmitted by the ultrasonic transmitter 114*a* and passes through the paper or papers, and generates and outputs an ultrasonic signal comprised of an electrical signal corresponding to the detected ultrasonic wave. Below, the ultrasonic transmitter 114*a* and the ultrasonic receiver 114*b* will sometimes be referred to altogether as the "ultrasonic sensor 114".

The third paper detector 117 has a contact detection sensor which is arranged at a downstream side of the first conveyor roller 115 and the first driven roller 116 and an upstream side of the first image capture unit 118*a* and the second image capture unit 118*b* and detects if there is a paper at that position. The third paper detector 117 generates and outputs a third paper detection signal which changes in signal value between a state where there is a paper at that position and a state where there is no such paper there.

The first image capture unit 118*a* has a CIS (contact image sensor) of an equal magnification optical system type which is provided with an image capture element using CMOS's (complementary metal oxide semiconductors) which are arranged in a line in the main scan direction. This CIS reads the back surface of the paper and generates and outputs an analog image signal. Similarly, the second image capture unit 118*b* has a CIS of an equal magnification optical system type which is provided with an image capture element using CMOS's which are arranged in a line in the main scan direction. This CIS reads the front surface of the paper and generates and outputs an analog image signal. Note that, it is also possible to arrange only one of the first image capture unit 118*a* and the second image capture unit 118*b* and read only one surface of the paper. Further, instead of a CIS, it is also possible to utilize an image capturing sensor of a reduced magnification optical system type using CCD's (charge coupled devices). Below, the first image capture unit 118*a* and the second image capture unit 118*b* will sometimes be referred to overall as the "image capture unit 118".

A paper which is placed on the paper tray 103 is conveyed between the lower guide 107*a* and the upper guide 107*b* toward the paper conveyance direction A2 by rotation of the paper feed roller 111 in the direction of the arrow mark A3 of FIG. 2. The retard roller 112 rotates in the direction of the arrow mark A4 of FIG. 2 at the time of paper conveyance. Due to the action of the paper feed roller 111 and the retard roller 112, when the paper tray 103 has a plurality of papers placed on it, among the papers which are placed on the paper tray 103, only the paper which is in contact with the paper feed roller 111 is separated. The conveyance of papers other than the separated paper is restricted (prevention of multifeed). The paper feed roller 111 and the retard roller 112 function as a paper separator.

A paper is fed between the first conveyor roller 115 and the first driven roller 116 while being guided by the lower guide 107*a* and the upper guide 107*b*. The paper is sent between the first image capture unit 118*a* and the second image capture unit 118*b* by the first conveyor roller 115 rotating in the direction of the arrow mark A5 of FIG. 2. The paper which is read by the image capture unit 118 is ejected onto the ejection tray 105 by the second conveyor roller 119 rotating in the direction of the arrow mark A6 of the FIG. 2.

Figure 3:
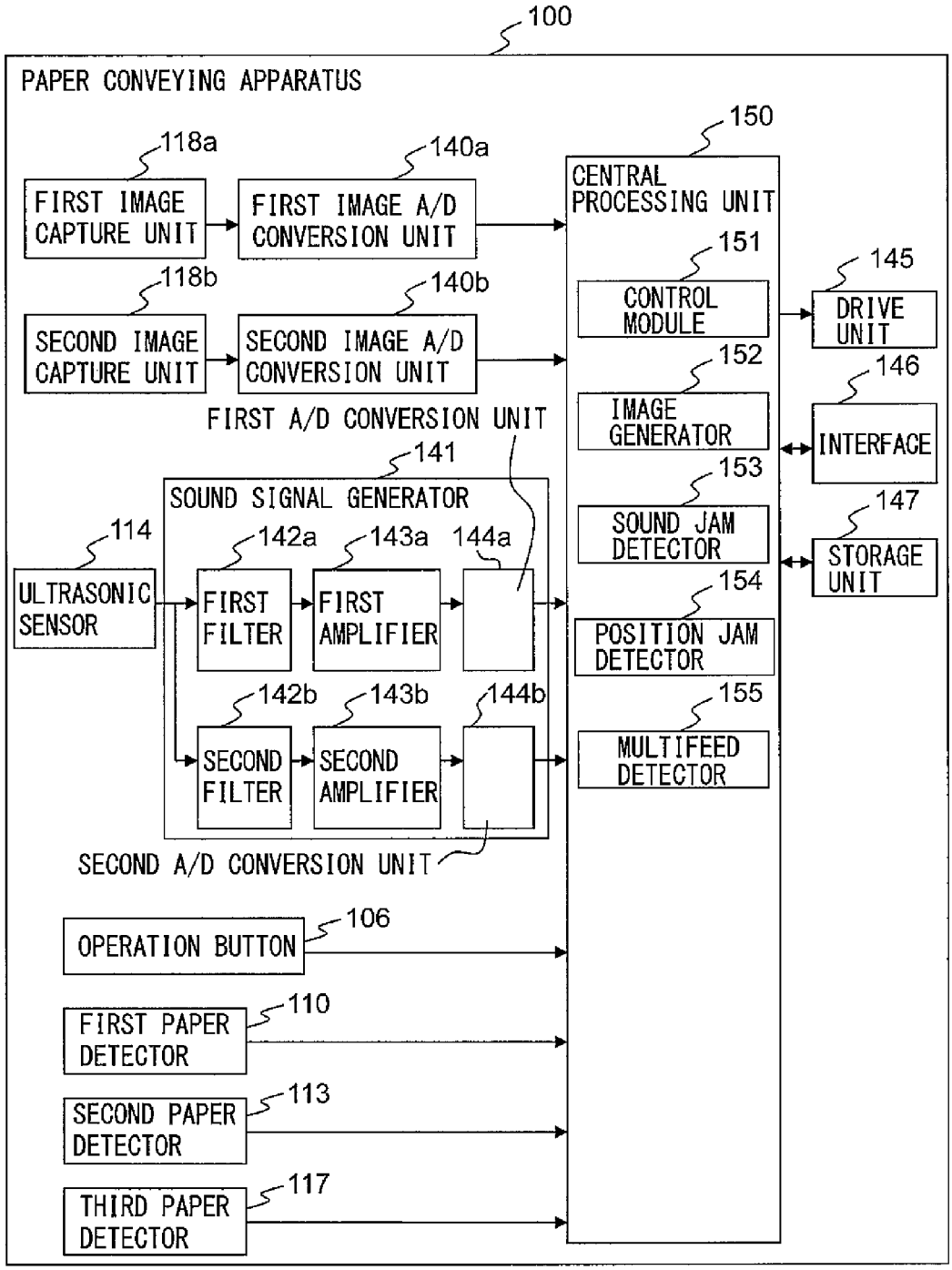
FIG. 3 is an example of a block diagram which shows a schematic configuration of a paper conveying apparatus 100.

FIG. 3 is an example of a block diagram which shows the general configuration of a paper conveying apparatus 100.

The paper conveying apparatus 100, in addition to the above-mentioned configuration, further has a first image A/D conversion unit 140*a*, a second image A/D conversion unit 140*b*, a filter 141, a drive unit 145, an interface 146, a storage unit 147, a central processing unit 150, etc.

The first image A/D conversion unit 140*a* converts an analog image signal which is output from the first image capture unit 118*a* from an analog to digital format to generate digital image data which it then outputs to the central processing unit 150. Similarly, the second image A/D conversion unit 140*b* converts the analog image signal which is output from the second image capture unit 118*b* from an analog to digital format to generate digital image data which it then outputs to the central processing unit 150. Below, these digital image data will be referred to as the "read image".

The filter 141 includes a first filter 142*a*, a second filter 142*b*, a first amplifier 143*a*, a second amplifier 143*b*, a first A/D conversion unit 144*a*, a second A/D conversion unit 144*b*, etc.

The first filter 142*a* applies a bandpass filter which passes a signal of a predetermined first frequency band to the analog ultrasonic signal which is output from the ultrasonic sensor 114 and outputs the signal to the first amplifier 143*a*. The first frequency band is the band where the signal value greatly attenuates when there are several sheets of paper through which ultrasonic waves pass compared with when there is a single sheet of paper through which ultrasonic waves pass. For example, it may be made a frequency band of 20 kHz to 300 kHz. The first amplifier 143*a* amplifies the signal which is output from the first filter 142*a* and outputs it to the first A/D conversion unit 144*a*. The first A/D conversion unit 144*a* converts the analog signal which is output from the first amplifier 143*a* to a digital signal and outputs it to the central processing unit 150. Below, the signal of the component of the first frequency band which is output from the first A/D conversion unit 144*a* will sometimes be referred to as the "first ultrasonic signal".

The second filter 142*b* applies a bandpass filter which passes a signal of a predetermined second frequency band lower than the first frequency band to the analog ultrasonic signal which is output from the ultrasonic sensor 114 and outputs the signal to the second amplifier 143*b*. The second frequency band can be made the audible range, for example, a frequency band of 20 Hz to less than 20 kHz. The second amplifier 143*b* amplifies the signal which is output from the second filter 142*b* and outputs it to the second A/D conversion unit 144*b*. The second A/D conversion unit 144*b* converts the analog signal which is output from the second amplifier 143*b* to a digital signal and outputs it to the central processing unit 150. Below, the signal of the component of the second frequency band which is output from the second A/D conversion unit 144*b* will sometimes be referred to as the "second ultrasonic signal". The filter 141 separates the component of the first frequency band and the component of the second frequency band from the ultrasonic signal.

The drive unit 145 includes one or more motors and uses control signals from the central processing unit 150 to rotate the paper feed roller 111, the retard roller 112, the first conveyor roller 115, and the second conveyor roller 119 and operate to convey a paper.

The interface 146 has, for example, a USB or other serial bus-based interface circuit and electrically connects with a not shown information processing apparatus (for example, personal computer, portable data terminal, etc.) to send and receive a read image and various types of information. Further, it is also possible to connect a flash memory etc., to the interface 146 so as to store the read image.

The storage unit 147 has a RAM (random access memory), ROM (read only memory), or other memory device, a hard disk or other fixed disk device, or flexible disk, optical disk, or other portable storage device. Further, the storage unit 147 stores a computer program, database, tables, etc., which are used in various processing of the paper conveying apparatus 100. The computer program may be installed on the storage unit 147 from a computer-readable, non-transitory medium such as a compact disk read only memory (CD-ROM), a digital versatile disk read only memory (DVD-ROM), or the like by using a well-known setup program or the like. Furthermore, the storage unit 147 stores the read image.

The central processing unit 150 is provided with a CPU (central processing unit) and operates based on a program which is stored in advance in the storage unit 147. Note that, the central processing unit 150 may also be comprised of a DSP (digital signal processor), LSI (large scale integrated circuit), ASIC (application specific integrated circuit), FPGA (field-programming gate array), etc.

The central processing unit 150 is connected to the operation button 106, first paper detector 110, second paper detector 113, ultrasonic sensor 114, third paper detector 117, first image capture unit 118*a*, second image capture unit 118*b*, first image A/D conversion unit 140*a*, second image A/D conversion unit 140*b*, filter 141, drive unit 145, interface 146, and storage unit 147 and controls these units.

The central processing unit 150 control a drive operation of the drive unit 145, control a paper read operation of the image capture unit 118, etc., to acquire a read image. Further, the central processing unit 150 has a control module 151, an image generator 152, a sound jam detector 153, a position jam detector 154, a multifeed detector 155, etc. These units are functional modules which are realized by software which operate on a processor. Note that, these units may be comprised of respectively independent integrated circuits, a microprocessor, firmware, etc.

Figure 4A:
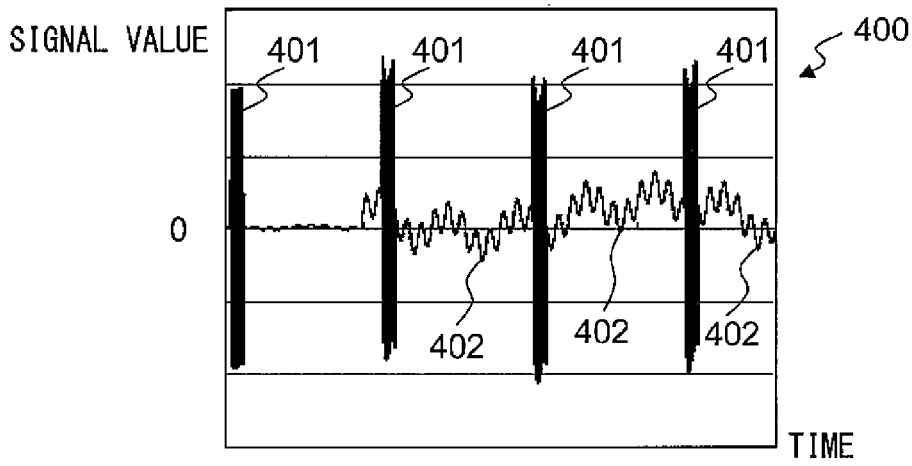
FIG. 4A a view for explaining properties of an ultrasonic signal.
Figure 4B:
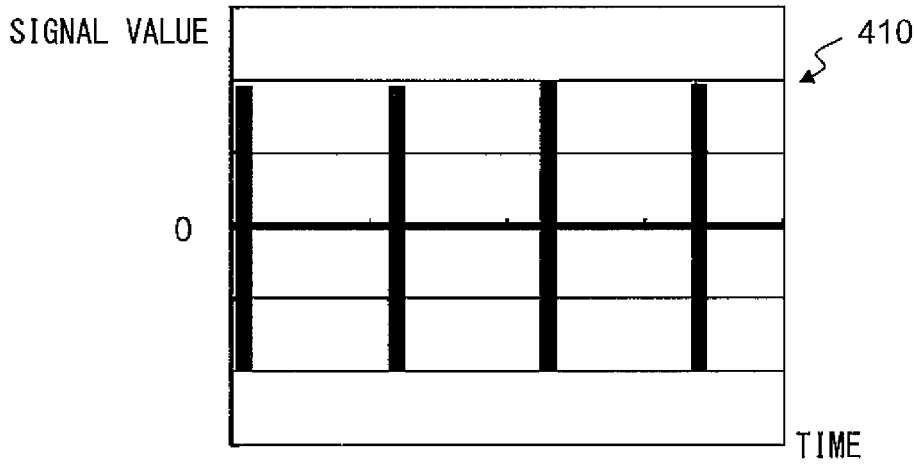
FIG. 4B a view for explaining properties of an ultrasonic signal.
Figure 4C:
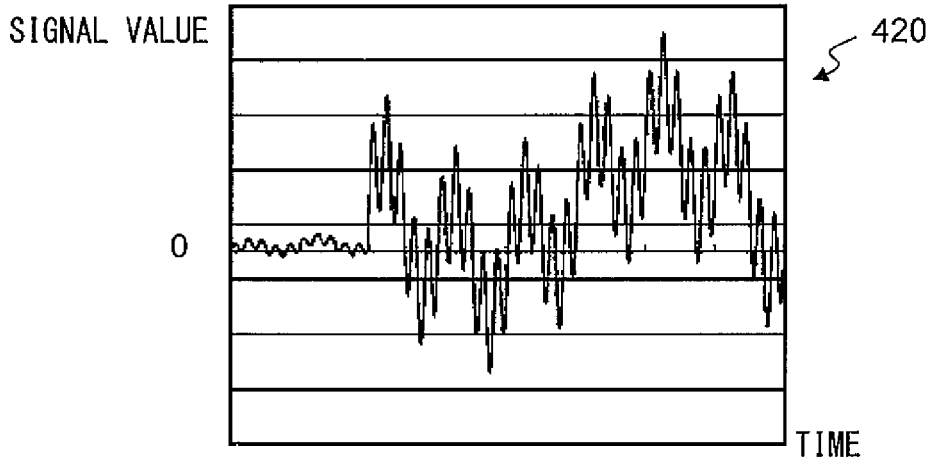
FIG. 4C a view for explaining properties of an ultrasonic signal.

FIG. 4A, FIG. 4B, and FIG. 4C are views for explaining properties of an ultrasonic signal.

In FIG. 4A, FIG. 4B, and FIG. 4C, the abscissa indicates the time, while the ordinate shows the signal value of the ultrasonic signal. The graph 400 of FIG. 4A shows an example of the analog ultrasonic signal which is output from the ultrasonic sensor 114. The ultrasonic signal of the graph 400 has a high frequency component 401 of 20 kHz or more and a low frequency component 402 of 20 Hz to less than 20 kHz. The high frequency component 401 is due to the ultrasonic wave which the ultrasonic transmitter 114*a* transmits, while the low frequency component 402 is due to the conveyance sound at the time of conveyance of paper.

The graph 410 of FIG. 4B shows the signal of the first frequency band, in the ultrasonic signal of the graph 400, which was output by the first filter 142*a* and amplified by the first amplifier 143*a*. As shown in FIG. 4B, the first filter 142*a* extracts the high frequency component 401 of 20 kHz or more, that is, the component by the ultrasonic wave which is transmitted by the ultrasonic transmitter 114*a*.

The graph 420 of FIG. 4C shows the signal of the second frequency band, in the ultrasonic signal of the graph 400, which was output by the second filter 142*b* and amplified by the second amplifier 143*b*. As shown in FIG. 4C, the second filter 142*b* extracts the low frequency component 402 of 20 Hz to less than 20 kHz, that is, the component by the sound of conveyance at the time of paper conveyance.

Figure 5:
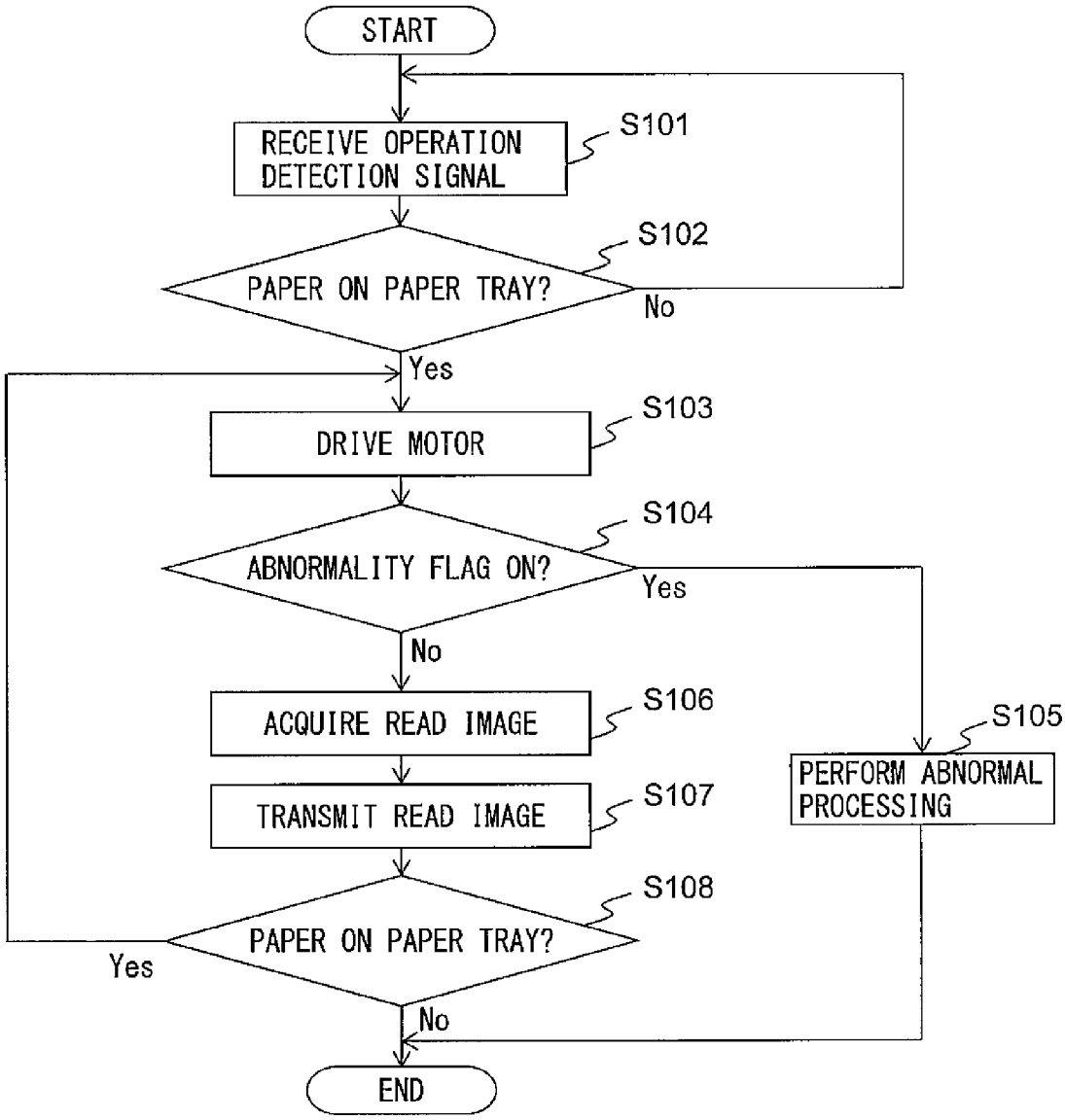
FIG. 5 is a flow chart which shows an example of an operation of overall processing of a paper conveying apparatus 100.

FIG. 5 is a flow chart which shows an example of operation of overall processing of the paper conveying apparatus 100.

Below, referring to the flow chart which is shown in FIG. 5, an example of the operation of the overall processing of the paper conveying apparatus 100 will be explained. Note that, the flow of the operation which is explained below is performed based on a program which is stored in advance in the storage unit 147 mainly by the central processing unit 150 in cooperation with the elements of the paper conveying apparatus 100.

First, the central processing unit 150 stands by until a user pushes the operation button 106 and an operation detection signal is received from the operation button 106 (step S101).

Next, the central processing unit 150 determines whether the paper tray 103 has a paper placed on it based on the first paper detection signal which was received from the first paper detector 110 (step S102).

If the paper tray 103 does not have a paper placed on it, the central processing unit 150 returns the processing to step S101 and stands by until newly receiving an operation detection signal from the operation button 106.

On the other hand, when the paper tray 103 has a paper placed on it, the central processing unit 150 drives the drive unit 145 to rotate the paper feed roller 111, retard roller 112, first conveyor roller 115, and second conveyor roller 119 and convey the paper (step S103).

Next, the control module 151 determines whether an abnormality flag is ON or not (step S104). This abnormality flag is set OFF at the time of startup of the paper conveying apparatus 100 and is set ON if a later explained abnormality detection processing determines that an abnormality has occurred.

When the abnormality flag is ON, the control module 151, as an abnormal processing, stops the drive unit 145 to stop the conveyance of the paper, uses a not shown speaker, LED (light emitting diode), etc. to notify the user of the occurrence of an abnormality, sets the abnormality flag OFF (step S105), and ends the series of steps.

On the other hand, when the abnormality flag is not ON, the image generator 152 makes the first image capture unit 118*a* and the second image capture unit 118*b* read the conveyed paper and acquires the read image through the first image A/D conversion unit 140*a* and the second image A/D conversion unit 140*b* (step S106).

Next, the central processing unit 150 transmits the acquired read image through the interface 146 to a not shown information processing apparatus (step S107). Note that, when not connected to an information processing apparatus, the central processing unit 150 stores the acquired read image in the storage unit 147.

Next, the central processing unit 150 determines whether the paper tray 103 has a paper remaining thereon based on the first paper detection signal which was received from the first paper detector 110 (step S108).

When the paper tray 103 has a paper remaining thereon, the central processing unit 150 returns the processing to step S103 and repeats the processing of steps S103 to S108. On the other hand, when the paper tray 103 does not have any paper remaining thereon, the central processing unit 150 ends the series of processing.

Figure 6:
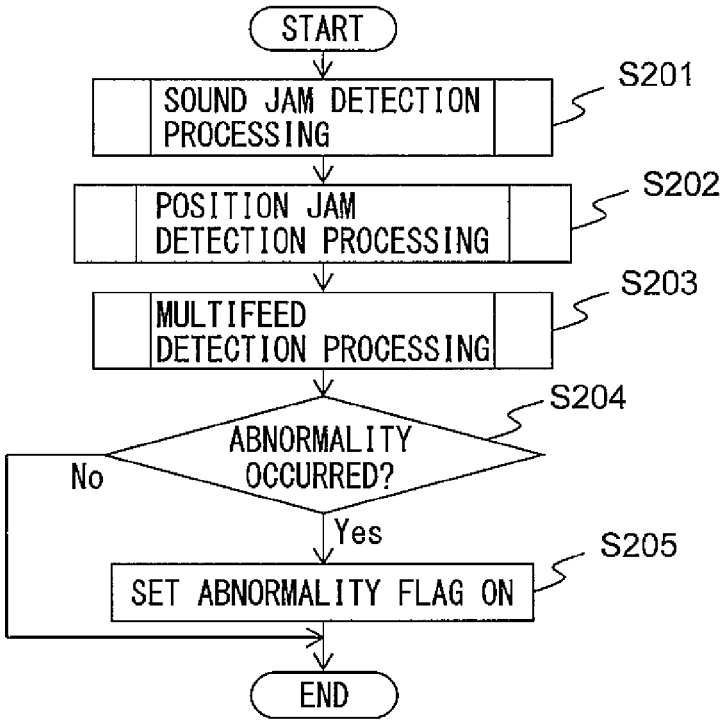
FIG. 6 is a flow chart which shows an example of an abnormality detection of the paper conveyance.

FIG. 6 is a flow chart which shows an example of an abnormality detection of the paper conveyance.

The flow of operation which is explained below is executed based on a program which is stored in advance in the storage unit 147 mainly by the central processing unit 150 in cooperation with the elements of the paper conveying apparatus 100.

First, the sound jam detector 153 executes sound jam detection processing (step S201). In the sound jam detection processing, the sound jam detector 153 determines whether a jam has occurred based on the second ultrasonic signal which is acquired from the filter 141. Below, sometimes a jam which is determined to exist by the sound jam detector 153 based on the second ultrasonic signal will be called a "sound jam". Details of the sound jam detection processing will be explained later.

Next, the position jam detector 154 performs position jam detection processing (step S202). In the position jam detection processing, the position jam detector 154 determines the occurrence of a jam based on the second paper detection signal which is acquired from the second paper detector 113 and the third paper detection signal which is acquired from the third paper detector 117. Below, sometimes a jam which is determined to exist by the position jam detector 154 based on the second paper detection signal and third paper detection signal will be called a "position jam". Details of the position jam detection processing will be explained later.

Next, the multifeed detector 155 performs multifeed detection processing (step S203). In the multifeed detection processing, the multifeed detector 155 determines the occurrence of a multifeed of papers based on the ultrasonic signal which was acquired from the ultrasonic sensor 114. Details of the multifeed detection processing will be explained later.

Next, the control module 151 determines whether an abnormality has occurred in the paper conveyance processing (step S204). Details of the abnormality detection processing will be explained later.

The control module 151 sets the abnormality flag to ON (step S205) and ends the series of steps when an abnormality occurs in the paper conveyance processing. On the other hand, when no abnormality occurs in the paper conveyance processing, it ends the series of steps without particularly performing any further processing. Note that, the flow chart which is shown in FIG. 5 is repeatedly executed every predetermined time interval.

Figure 7:
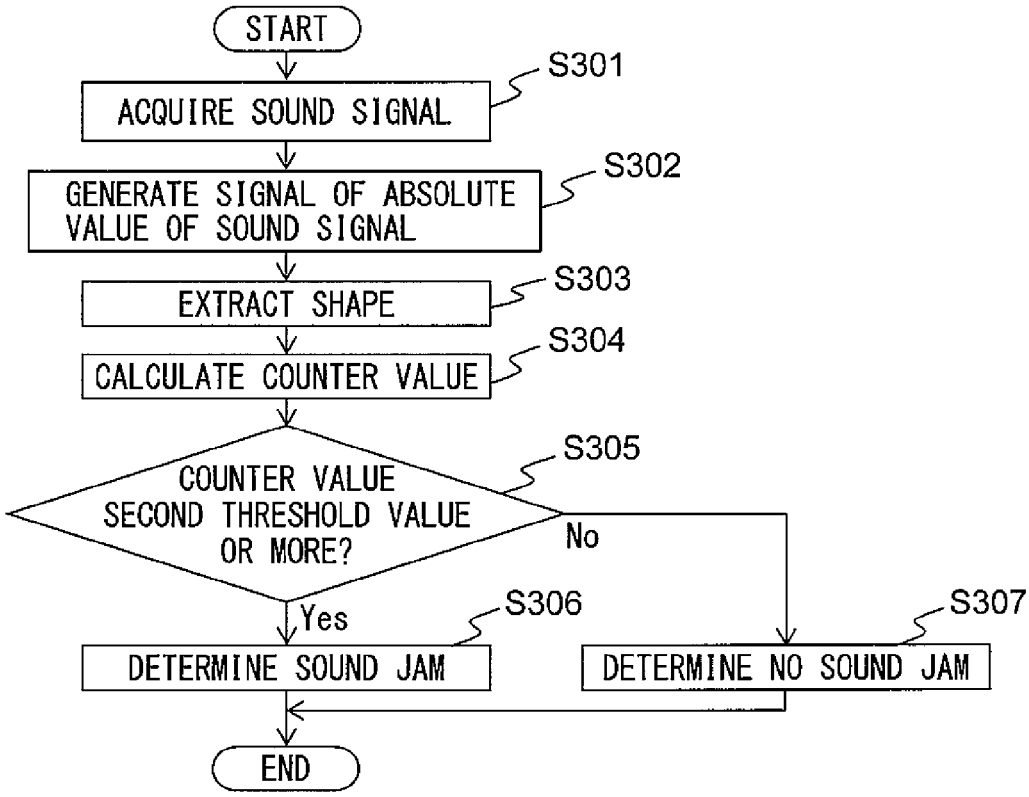
FIG. 7 is a flow chart which shows an example of operation of sound jam detection processing.

FIG. 7 is a flow chart which shows an example of operation of a sound jam detection processing.

The flow of operation which is shown in FIG. 7 is executed at step S201 of the flow chart which is shown in FIG. 6.

First, the sound jam detector 153 acquires the second ultrasonic signal from the ultrasonic sensor 114 through the second filter 142*b*, second amplifier 143*b*, and second A/D conversion unit 144*b* (step S301).

Figure 8A:
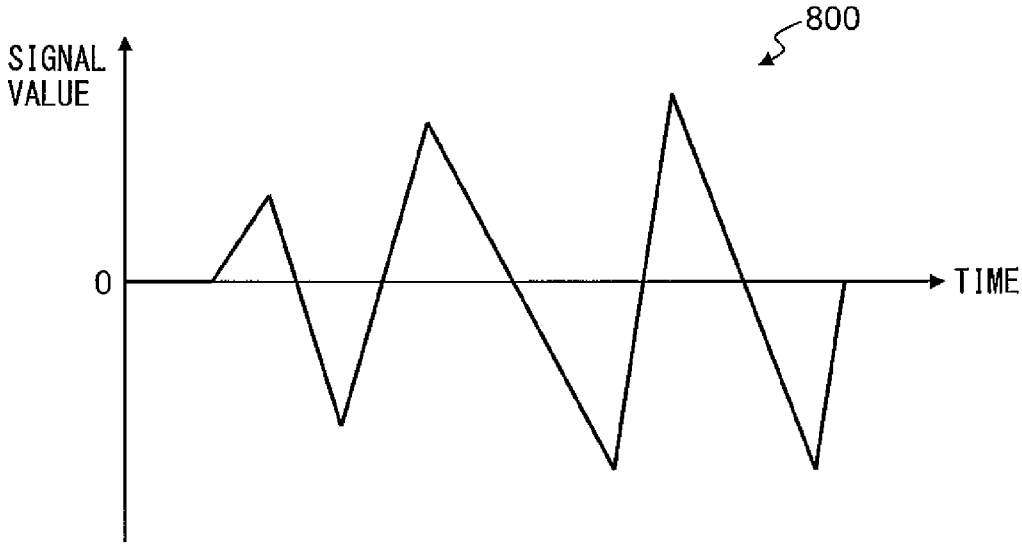
FIG. 8A is a graph which shows an example of a second ultrasonic signal.

FIG. 8A is a graph which shows an example of the second ultrasonic signal. The graph 800 which is shown in FIG. 8A shows a digital second ultrasonic signal which is received from the second A/D conversion unit 144*b*. The abscissa of graph 800 shows the time, while the ordinate shows the second signal value of the ultrasonic signal.

Next, the sound jam detector 153 generates a signal of the absolute value of the second ultrasonic signal which is received from the second A/D conversion unit 144*b* (step S302).

Figure 8B:
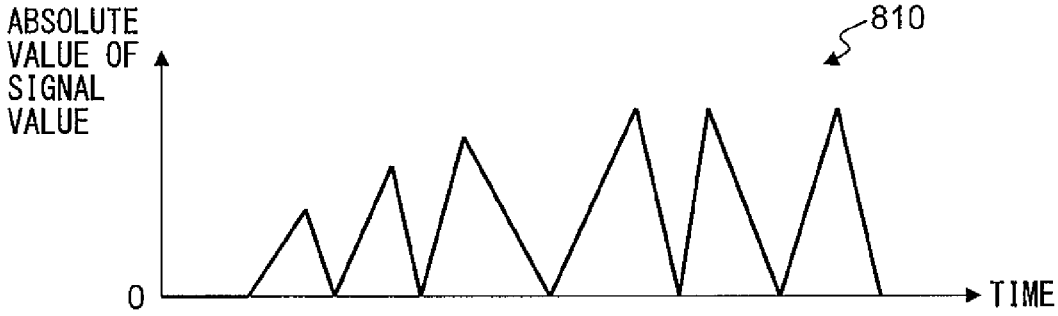
FIG. 8B is a graph which shows an example of a signal of the absolute value of a second ultrasonic signal.

FIG. 8B is a graph which shows an example of the signal of the absolute value of the second ultrasonic signal. The graph 810 which is shown in FIG. 8B shows a signal of the absolute value of the second ultrasonic signal of the graph 800. The abscissa of graph 810 shows the time, while the ordinate shows the absolute value of the second signal value of the ultrasonic signal.

Next, the sound jam detector 153 extracts the shape of the signal of the absolute value of the second ultrasonic signal (step S303). The sound jam detector 153 extracts an envelope as the shape of the signal which obtains the absolute value of the second ultrasonic signal.

Figure 8C:
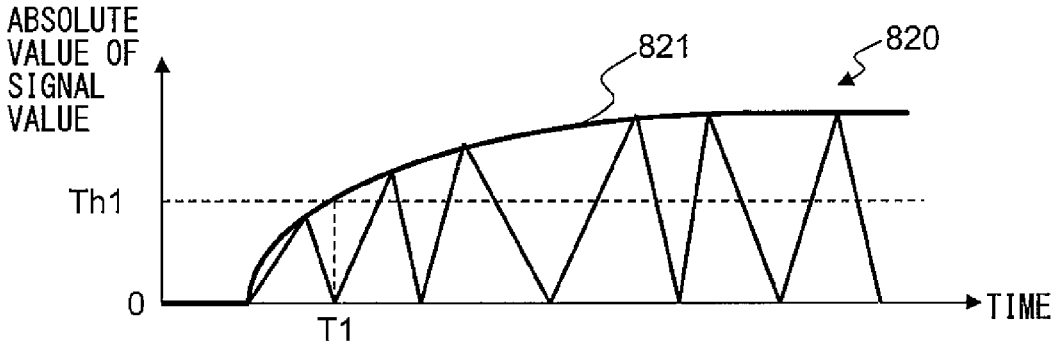
FIG. 8C is a graph which shows an example of a shape of a signal of the absolute value of the second ultrasonic signal.

FIG. 8C is a graph which shows an example of the shape of the signal of the absolute value of the second ultrasonic signal. The graph 820 which is shown in FIG. 8C shows the envelope 821 of the signal of the absolute value of the second ultrasonic signal of the graph 810. The abscissa of the graph 820 shows the time, while the ordinate shows the absolute value of the second signal value of the ultrasonic signal.

Next, the sound jam detector 153 calculates a counter value which it increases when the shape of the signal of the absolute value of the second ultrasonic signal is a first threshold value Th1 or more and which it decreases when it is less than the first threshold value Th1 (step S304). The sound jam detector 153 determines whether the value of the envelope 821 is the first threshold value Th1 or more every predetermined time interval (for example, sampling interval of second ultrasonic signal), increments the counter value when the value of the envelope 821 is the first threshold value Th1 or more, and decreases the counter value when it is less than the first threshold value Th1.

Figure 8D:
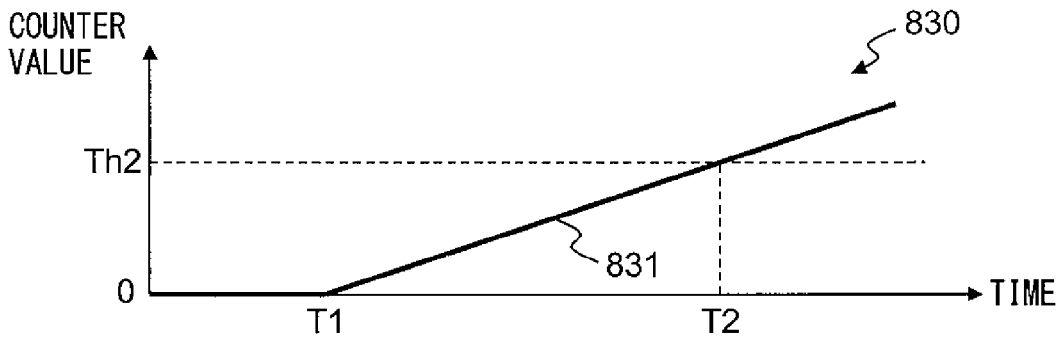
FIG. 8D is a graph which shows an example of a counter value.

FIG. 8D is a graph which shows an example of the counter value which was calculated for shape of the signal of the absolute value of the second ultrasonic signal. The graph 830 which is shown in FIG. 8D shows the counter value which was calculated for the envelope 821 of the graph 820. The abscissa of the graph 820 shows the time, while the ordinate shows the counter value.

Next, the sound jam detector 153 determines whether the counter value is a second threshold value Th2 or more (step S305). The sound jam detector 153 determines that a sound jam has occurred if the counter value is the second threshold value Th2 or more (step S306), determines that a sound jam has not occurred if the counter value is less than the second threshold value Th2 (step S307), and then ends the series of steps.

In FIG. 8C, the envelope 821 is the first threshold value Th1 or more at the time T1 and thereafter does not become less than the first threshold value Th1. For this reason, as shown in FIG. 8D, the counter value increases from the time T1 and becomes the second threshold value Th2 or more at the time T2, then the sound jam detector 153 determines that a sound jam has occurred.

Note that, at step S303, instead of acquiring the envelope as the shape of the signal of the absolute value of the second ultrasonic signal, the sound jam detector 153 may acquire a signal of the peak hold for the signal of the absolute value of the second ultrasonic signal (below, referred to as the "peak hold signal"). For example, the central processing unit 150 holds the local maximum value of the signal of the absolute value of the second ultrasonic signal for a predetermined hold period and then attenuates it by a constant attenuation rate to acquire the peak hold signal.

Figure 9A:
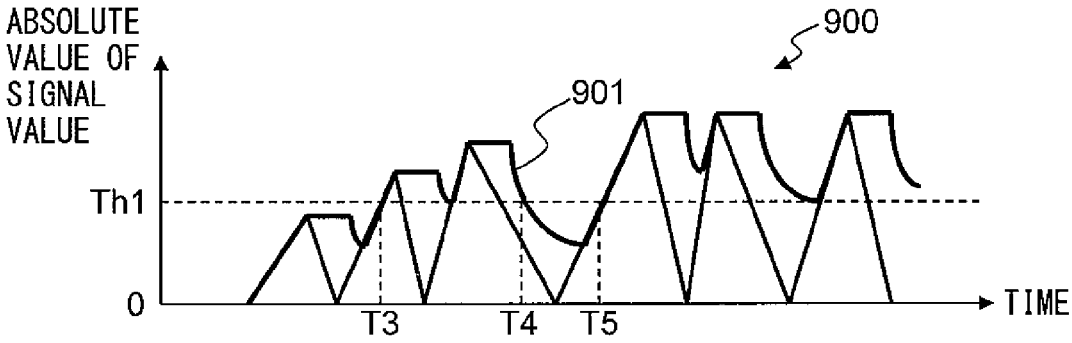
FIG. 9A is a view for explaining processing for detection of occurrence of a jam.
Figure 9B:
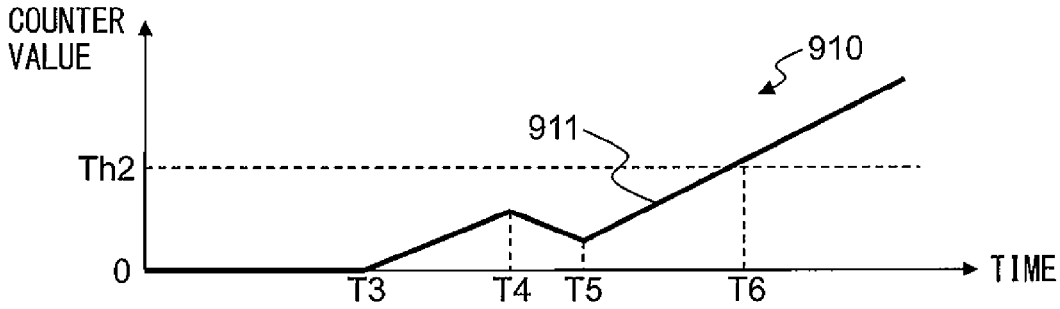
FIG. 9B is a view for explaining processing for detection of occurrence of a jam.

FIG. 9A and FIG. 9B are views for explaining a processing for acquiring the peak hold signal from the second ultrasonic signal and determining whether a sound jam has occurred.

The graph 900 which is shown in FIG. 9A shows the peak hold signal 901 for the signal of the absolute value of the second ultrasonic signal of the graph 810. The abscissa of the graph 900 shows the time, while the ordinate shows the absolute value of the second signal value of the ultrasonic signal.

The graph 910 which is shown in FIG. 9B shows the counter value which was calculated for the peak hold signal 901 of the graph 900. The abscissa of the graph 910 shows the time, while the ordinate shows the counter value. The peak hold signal 901 becomes the first threshold value Th1 or more at the time T3, becomes less than the first threshold value Th1 at the time T4, again becomes the first threshold value Th1 or more at the time T5, and does not become less than the first threshold value Th1 after that. For this reason, as shown in FIG. 9B, the counter value increases from the time T3, decreases from the time T4, again increases from the time T5, and becomes the second threshold value Th2 or more at the time T6, so it is determined that a sound jam has occurred.

Figure 10A:
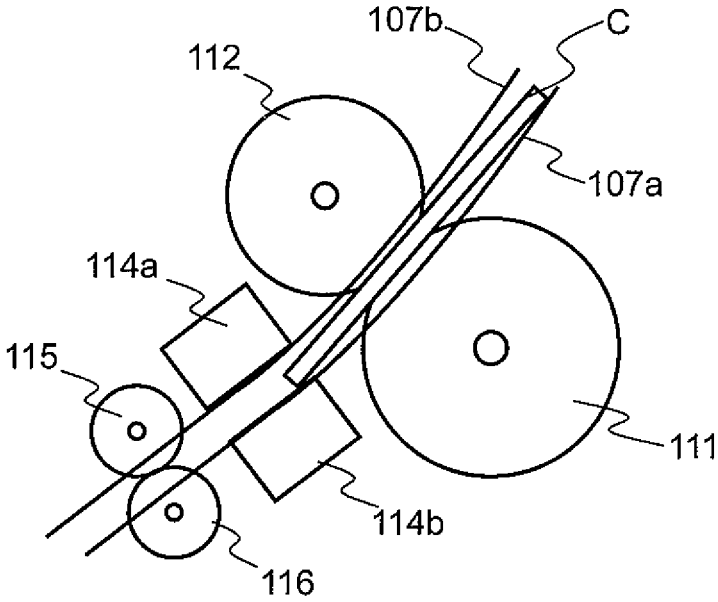
FIG. 10A is a view for explaining a case where a card is conveyed.
Figure 10B:
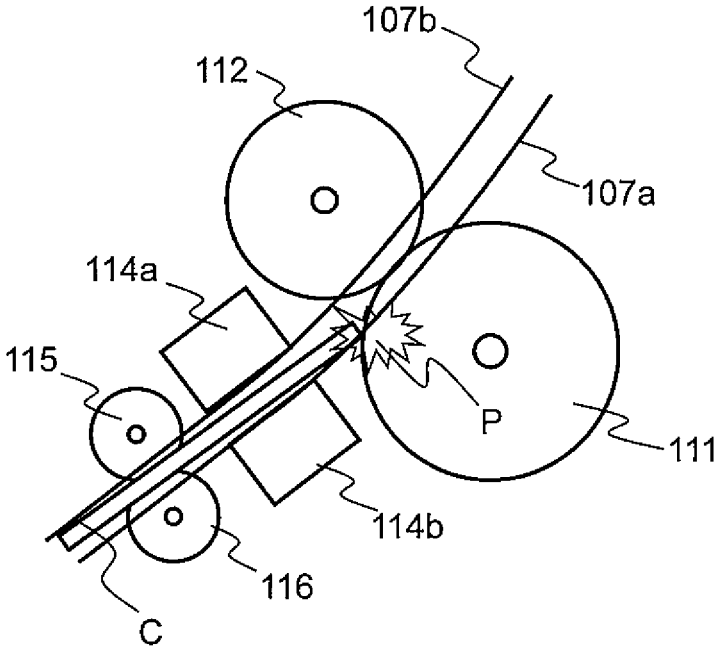
FIG. 10B is a view for explaining a case where a card is conveyed.

FIG. 10A and FIG. 10B are views for explaining the case where a card is conveyed.

FIG. 10A shows the state where a plastic or other high rigidity card C is gripped between the paper feed roller 111 and the retard roller 112. If the card C is further conveyed from the state of FIG. 10A, the state of FIG. 10A shifts to the state of FIG. 10B.

The upper guide 107*b* and the lower guide 107*a* are arranged bent, so if the card C is further gripped by the first conveyor roller 115 and the first driven roller 116 in the state gripped between the paper feed roller 111 and the retard roller 112, it deforms due to its elasticity. For this reason, as shown in FIG. 10B, when the rear end of the card C separates from the paper feed roller 111 and the retard roller 112, the card C tries to return to its original state from the deformed state, so sometimes contacts the lower guide 107*a* at the point P and impact sound is issued. The impact sound which is generated when the card C contacts the lower guide 107*a* ends up being detected by the ultrasonic receiver 114*b*.

The sound jam detector 153 may mistakenly determine that a jam has occurred due to the above detected impact sound. Note that, FIG. 9A and FIG. 9B show an example of a conveyance path in which an impact sound is emitted at the time of separation from the conveyor roller, but the invention is not limited to this. Further, in addition to a plastic card as well, a high rigidity thick paper may also emit an impact sound similar to a plastic card. Furthermore, even if the conveyance path is not bent, but is flat, an impact sound may be emitted due to the step difference of the rollers.

Figure 11:
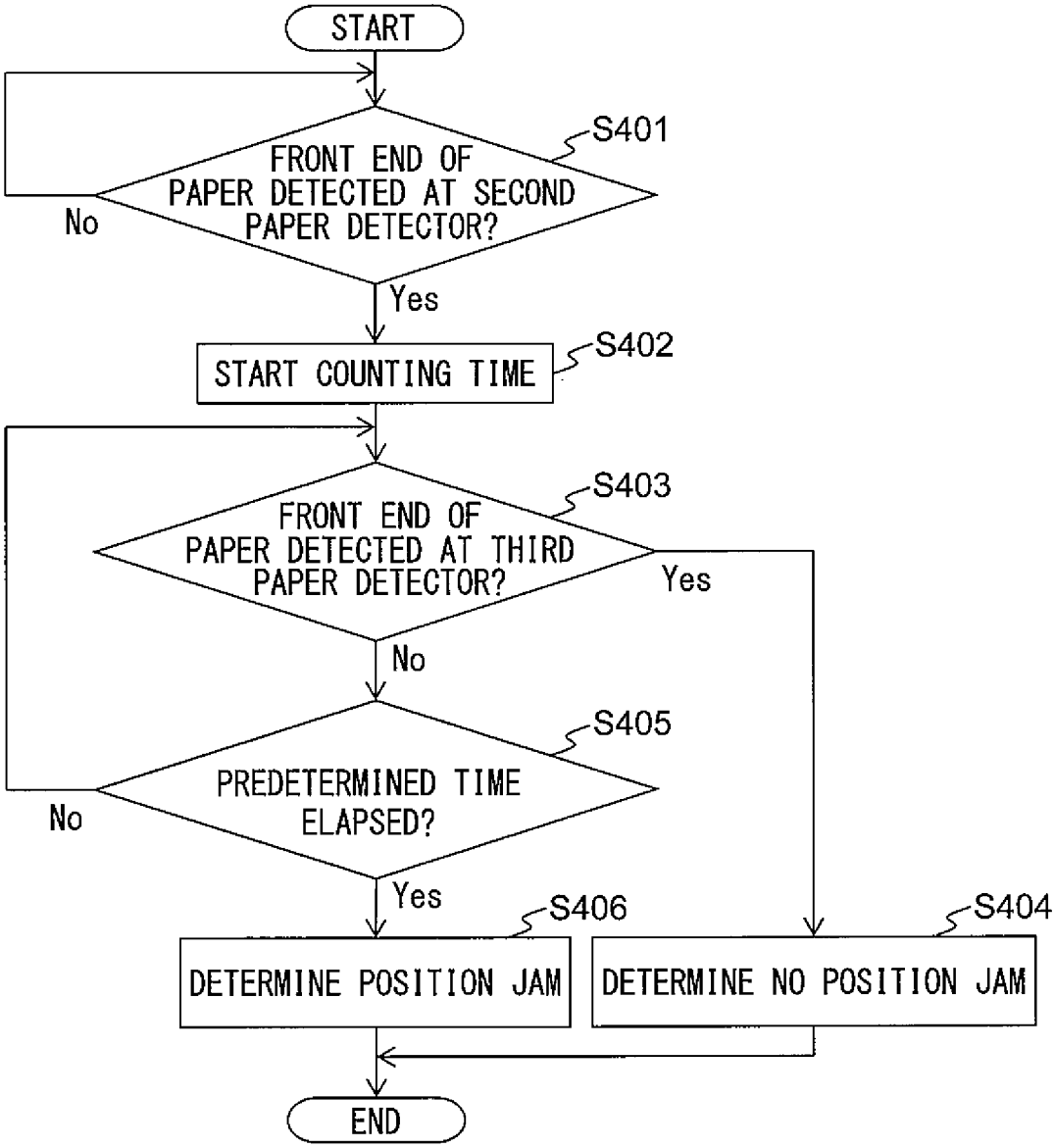
FIG. 11 is a flow chart which shows an example of operation of position jam detection processing.

FIG. 11 is a flow chart which shows an example of operation of a position jam detection processing.

The flow of operation which is shown in FIG. 11 is executed at step S202 of the flow chart which is shown in FIG. 6.

First, the position jam detector 154 stands by until the front end of the paper is detected by the second paper detector 113 (step S401). The position jam detector 154 determines that the front end of the paper is detected at the position of the second paper detector 113, that is, downstream of the paper feed roller 111 and retard roller 112 and upstream of the first conveyor roller 115 and first driven roller 116, when the value of the second paper detection signal from the second paper detector 113 changes from a value which shows the state where there is no paper to a value which shows the state where there is one.

Next, when the second paper detector 113 detects the front end of a paper, the position jam detector 154 starts counting time (step S402).

Next, the position jam detector 154 determines whether the third paper detector 117 has detected the front end of the paper (step S403). The position jam detector 154 determines that the front end of the paper is detected at the position of the third paper detector 117, that is, downstream of the first conveyor roller 115 and first driven roller 116 and upstream of the image capture unit 118, when the value of the third paper detection signal from the third paper detector 117 changes from a value which shows the state where there is no paper to a value which shows the state where there is one.

When the third paper detector 117 detects the front end of a paper, the position jam detector 154 determines that no position jam has occurred (step S404) and ends the series of steps.

On the other hand, if the third paper detector 117 detects the front end of the paper, the position jam detector 154 determines whether a predetermined time (for example, 1 second) has elapsed from the start of counting time (step S405). If a predetermined time has not elapsed, the position jam detector 154 returns to the processing of step S403 and again determines whether the third paper detector 117 has detected the front end of the paper. On the other hand, when a predetermined time has elapsed, the position jam detector 154 determines that position jam has occurred (step S406) and ends the series of steps. Note that, when position jam detection processing is not required in the paper conveying apparatus 100, this may be omitted.

Note that, when the central processing unit 150 detects that the front end of a paper is downstream of the first conveyor roller 115 and the first driven roller 116 by the third paper detection signal from the third paper detector 117, it controls the drive unit 145 to stop the rotation of the paper feed roller 111 and retard roller 112 so that the next paper is not fed. After that, when the central processing unit 150 detects the rear end of the paper downstream of the paper feed roller 111 and the retard roller 112 by the second paper detection signal from the second paper detector 113, it again controls the drive unit 145 to rotate the paper feed roller 111 and retard roller 112 and convey the next paper. Due to this, the central processing unit 150 prevents a plurality of papers from being superposed in the conveyance path. For this reason, the position jam detector 154 may start counting the time at the point of time when the central processing unit 150 controls the drive unit 145 to rotate the paper feed roller 111 and the retard roller 112 and determine that a position jam has occurred when the third paper detector 117 does not detect the front end of a paper within a predetermined time.

Figure 12:
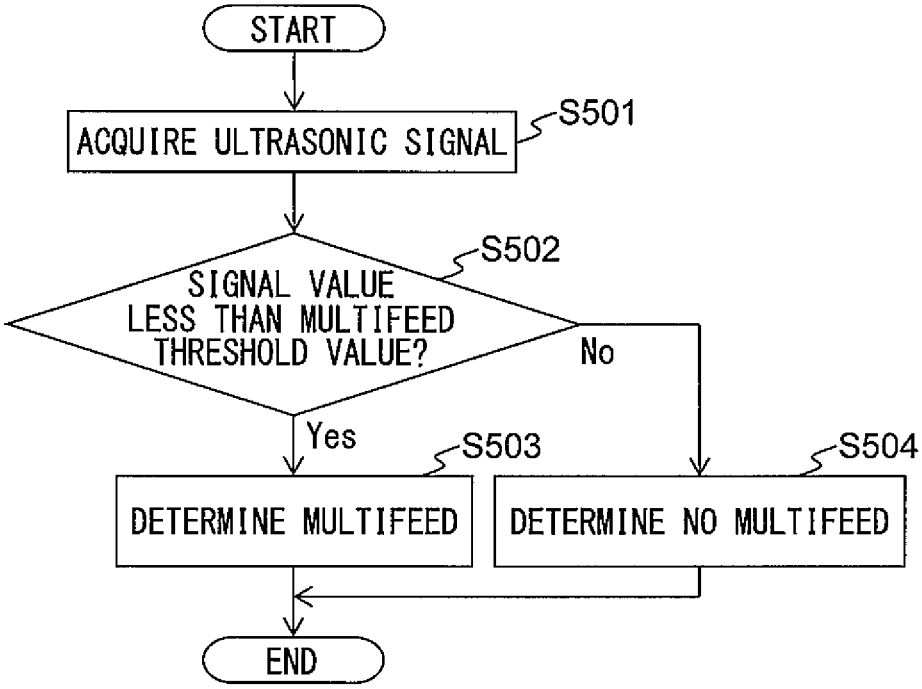
FIG. 12 is a flow chart which shows an example of operation of multifeed detection processing.

FIG. 12 is a flow chart which shows an example of operation of multifeed detection processing.

The flow of operation which is shown in FIG. 12 is executed at step S203 of the flow chart which is shown in FIG. 6.

First, the multifeed detector 155 acquires the first ultrasonic signal from the ultrasonic sensor 114 through the first filter 142*a*, first amplifier 143*a*, and first A/D conversion unit 144*a* (step S501).

Next, the multifeed detector 155 determines whether the acquired signal value of the first ultrasonic signal is less than the multifeed detection threshold value (step S502).

Figure 13:
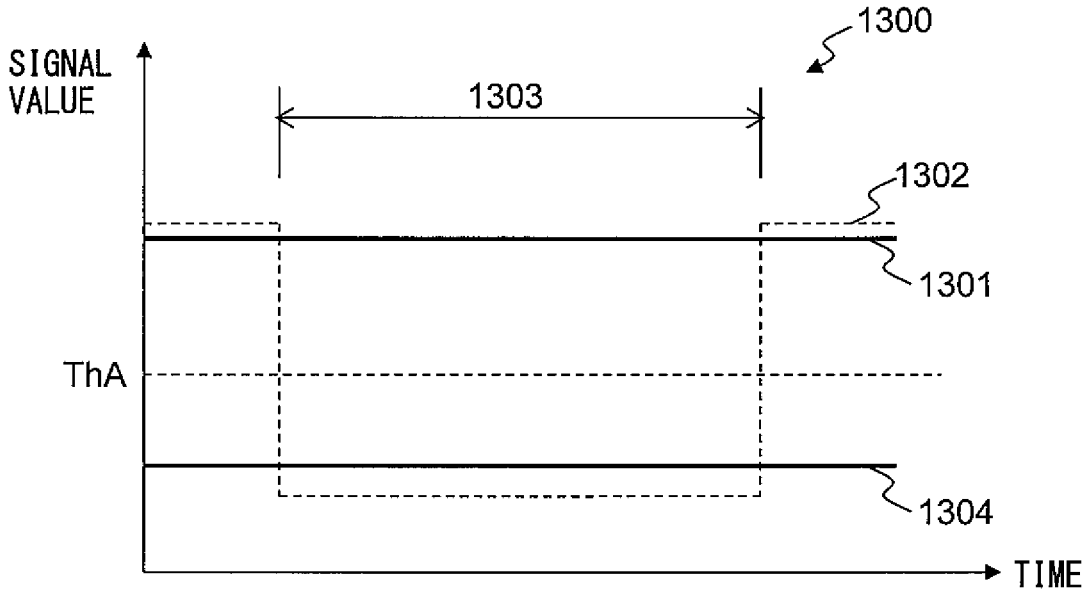
FIG. 13 is a first view for explaining properties of an ultrasonic signal.

FIG. 13 is a view for explaining properties of an ultrasonic signal.

In the graph 1300 of FIG. 13, the solid line 1301 shows the characteristic of the first ultrasonic signal in the case where a single paper is conveyed, while the broken line 1302 shows the characteristic of the first ultrasonic signal in the case where multifeed of papers has occurred. The abscissa of the graph 1300 shows the time, while the ordinate shows the signal value of the first ultrasonic signal. Due to the occurrence of multifeed, the signal value of the first ultrasonic signal of the broken line 1302 falls in the section 1303. For this reason, it is possible to determine whether multifeed of papers has occurred by whether the signal value of the first ultrasonic signal is less than the multifeed detection threshold value ThA.

On the other hand, the solid line 1304 shows the characteristic of the first ultrasonic signal in the case where just one plastic card thicker than paper is conveyed. When a card is conveyed, the signal value of the first ultrasonic signal becomes smaller than the multifeed detection threshold value ThA, so the multifeed detector 155 mistakenly determines that a multifeed of papers has occurred. Note that, even if sufficiently thick, high rigidity thick paper has been conveyed, an ultrasonic signal which has characteristics similar to the case where a plastic card is conveyed is detected, so the multifeed detector 155 is liable to mistakenly determine that a multifeed of papers has occurred.

The multifeed detector 155 determines that multifeed of the papers has occurred when the signal value of the first ultrasonic signal is less than the multifeed detection threshold value (step S503), determines that multifeed of the papers has not occurred when the signal value of the first ultrasonic signal is the multifeed detection threshold value or more (step S504), and ends the series of steps.

Figure 14:
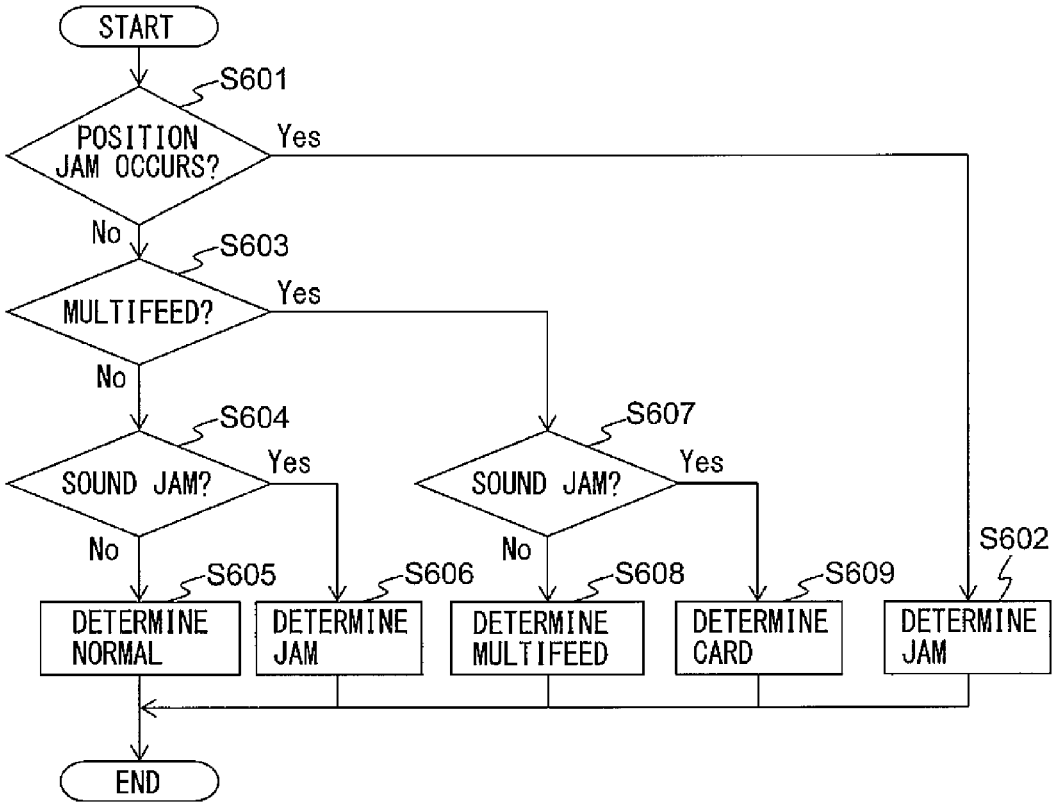
FIG. 14 is a flow chart which shows an example of operation of abnormality detection processing.

FIG. 14 is a flow chart which shows an example of operation of abnormality detection processing.

The flow of operation which is shown in FIG. 14 is performed at step S204 of the flow chart which is shown in FIG. 6.

First, the control module 151 determines whether the position jam detector 154 has determined that a position jam has occurred (step S601). When the position jam detector 154 has determined that a position jam has occurred, the control module 151 determines that a jam has occurred and an abnormality has occurred (step S602) and ends the series of steps.

When the position jam detector 154 has not determined that a position jam has occurred, the control module 151 determines whether the multifeed detector 155 has determined that a multifeed has occurred (step S603).

When the multifeed detector 155 has not determined that a multifeed has occurred, the control module 151 determines whether the sound jam detector 153 has determined that a sound jam has occurred (step S604).

When the sound jam detector 153 has not determined that a sound jam has occurred, the control module 151 determines that neither multifeed of papers nor a jam has occurred and the state is normal (step S605), then ends the series of steps.

On the other hand, when the sound jam detector 153 determines that a sound jam has occurred, the control module 151 determines that a jam has occurred and an abnormality has occurred (step S606) and ends the series of steps.

Further, at step S603, when the multifeed detector 155 has determined that a multifeed has occurred, the control module 151 determines whether the sound jam detector 153 has determined that a sound jam has occurred (step S607).

When the sound jam detector 153 has not determined that a sound jam has occurred, the control module 151 determines that a multifeed of papers has occurred and an abnormality has occurred (step S608) and ends the series of steps.

On the other hand, when the sound jam detector 153 determines that a sound jam has occurred, the control module 151 determines that a card or thick paper has been conveyed and thereby the multifeed detector 155 has determined that a multifeed has occurred and the sound jam detector 153 has determined that a sound jam has occurred. In this case, the control module 151 determines that neither a multifeed of papers nor a jam has occurred and the state is normal (step S609) then ends the series of steps.

Note that, in the flow chart which is shown in FIG. 14, the processing for detection of a position jam which is shown at steps S601 and S602 may also be omitted and any occurrence of a multifeed of papers and any occurrence of a jam may be simply determined from only the results of detection of any multifeed by the multifeed detector 155 and the results of detection of any sound jam by the sound jam detector 153. In this case as well, when a card or thick paper has been conveyed, the control module 151 can determine that neither a multifeed of papers nor a jam has occurred.

As explained above in detail, the paper conveying apparatus 100 operates in accordance with the flow chart which is shown in FIG. 5, FIG. 6, FIG. 7, FIG. 11, FIG. 12, and FIG. 14 and uses the ultrasonic signal which the ultrasonic sensor 114 outputs for determining any occurrence of multifeed of papers so as to determine whether a jam has occurred. Therefore, the paper conveying apparatus 100 can determine any occurrence of a sound jam at a low cost with provision of dedicated microphones.

Further, even when the paper conveying apparatus 100 determines that multifeed has occurred based on the first ultrasonic signal, if determining that the sound which the paper generated during conveyance of the paper is sufficiently large based on the second ultrasonic signal, it deems that a card or thick paper has been conveyed. Therefore, the paper conveying apparatus 100 can suppress erroneous detection of the occurrence of multifeed and erroneous detection of a jam when a card or thick paper has been conveyed.

Figure 15:
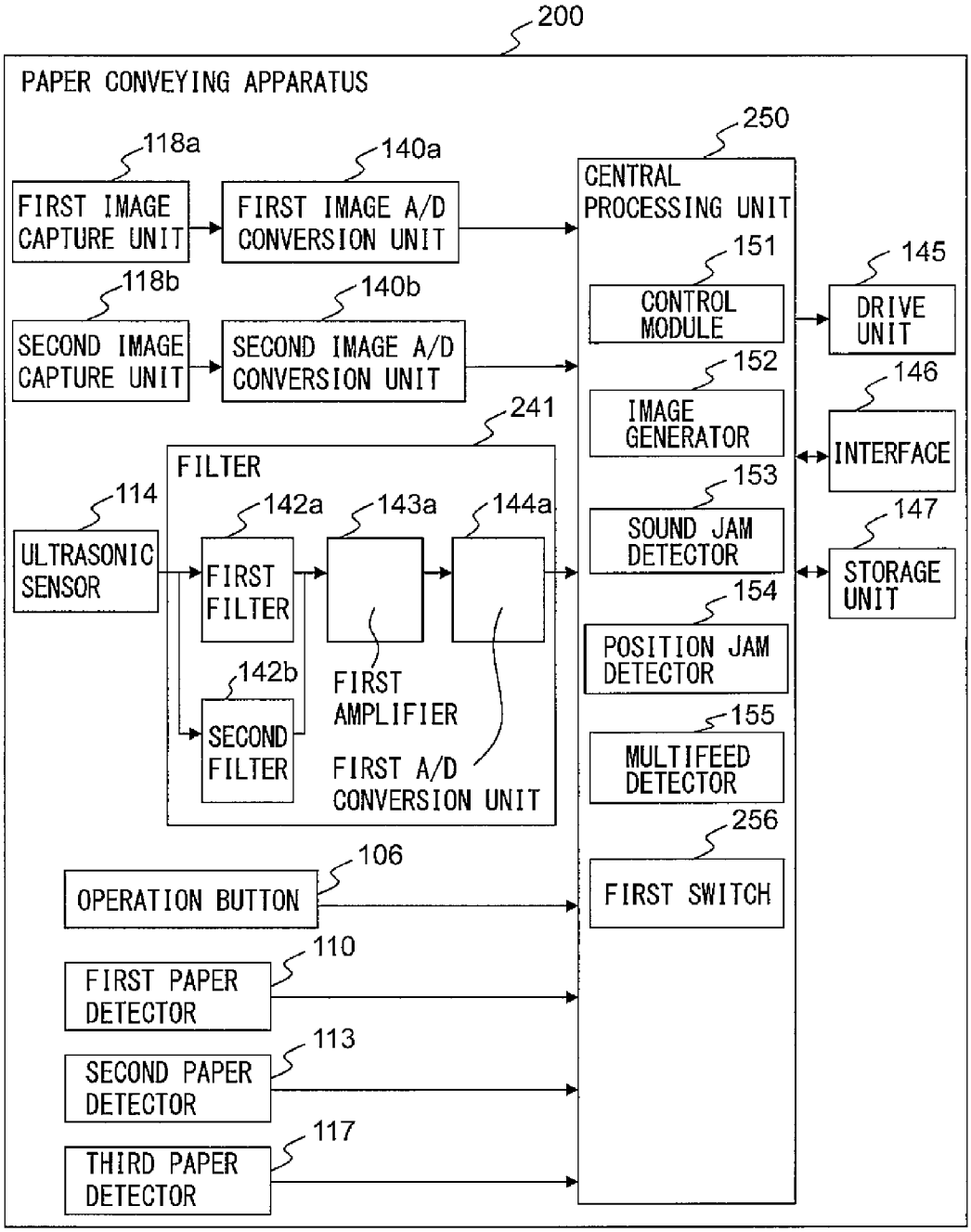
FIG. 15 is a block diagram which shows the schematic configuration of a paper conveying apparatus 200 according to another embodiment.

FIG. 15 is a block diagram which shows the schematic configuration of a paper conveying apparatus 200 according to another embodiment.

In a filter 241 of the paper conveying apparatus 200 which is shown in FIG. 15, among the parts of the filter 141 of the paper conveying apparatus 100 which is shown in FIG. 3, the second amplifier 143*b* and second A/D conversion unit 144*b* are omitted. Further, the central processing unit 250 of the paper conveying apparatus 200 has a first switch 256 in addition to the parts of the central processing unit 150 which is shown in FIG. 3.

The first filter 142*a* of the filter 241 applies a bandpass filter which passes a signal of a first frequency band to the analog ultrasonic signal which is output from the ultrasonic sensor 114 and outputs the signal to the first amplifier 143*a*. The second filter 142*b* applies a bandpass filter which passes a signal of a second frequency band to the analog ultrasonic signal which is output from the ultrasonic sensor 114 and outputs the signal to the first amplifier 143*a*. The first amplifier 143*a* amplifies the signal which either the first filter 142*a* or the second filter 142*b* outputs and outputs the result to the first A/D conversion unit 144*a*.

The first switch 256 switches the signal which the first amplifier 143*a* is made to amplify in accordance with the timing at which the ultrasonic transmitter 114*a* transmits an ultrasonic wave. The first switch 256 switches the signal so as to input the signal which is output from the first filter 142*a* while the ultrasonic transmitter 114*a* is transmitting an ultrasonic wave and so as to input the signal which is output from the second filter 142*b* while the ultrasonic transmitter 114*a* is not transmitting an ultrasonic wave.

The filter 241 outputs the first ultrasonic signal based on the component which the ultrasonic transmitter 114*a* transmits while the ultrasonic transmitter 114*a* is transmitting an ultrasonic wave and outputs the second ultrasonic signal based on the component due to the conveyance sound at the time of conveyance of the paper while the ultrasonic transmitter 114*a* is not transmitting an ultrasonic wave. While the ultrasonic transmitter 114*a* is transmitting an ultrasonic wave, the second ultrasonic signal is not generated, but the time period during which the ultrasonic transmitter 114*a* is transmitting an ultrasonic wave is sufficiently shorter than the time period in which it is not transmitting it, so the sound jam detector 153 can determine any occurrence of a sound jam without a problem.

As explained above in detail, the paper conveying apparatus 200 switches the signal which the first amplifier 143*a* is made to amplify in accordance with the timing at which the ultrasonic transmitter 114*a* transmits an ultrasonic wave, so the numbers of the amplifiers and A/D conversion units can be reduced and therefore it becomes possible to determine any occurrence of a sound jam by a lower cost.

Figure 16:
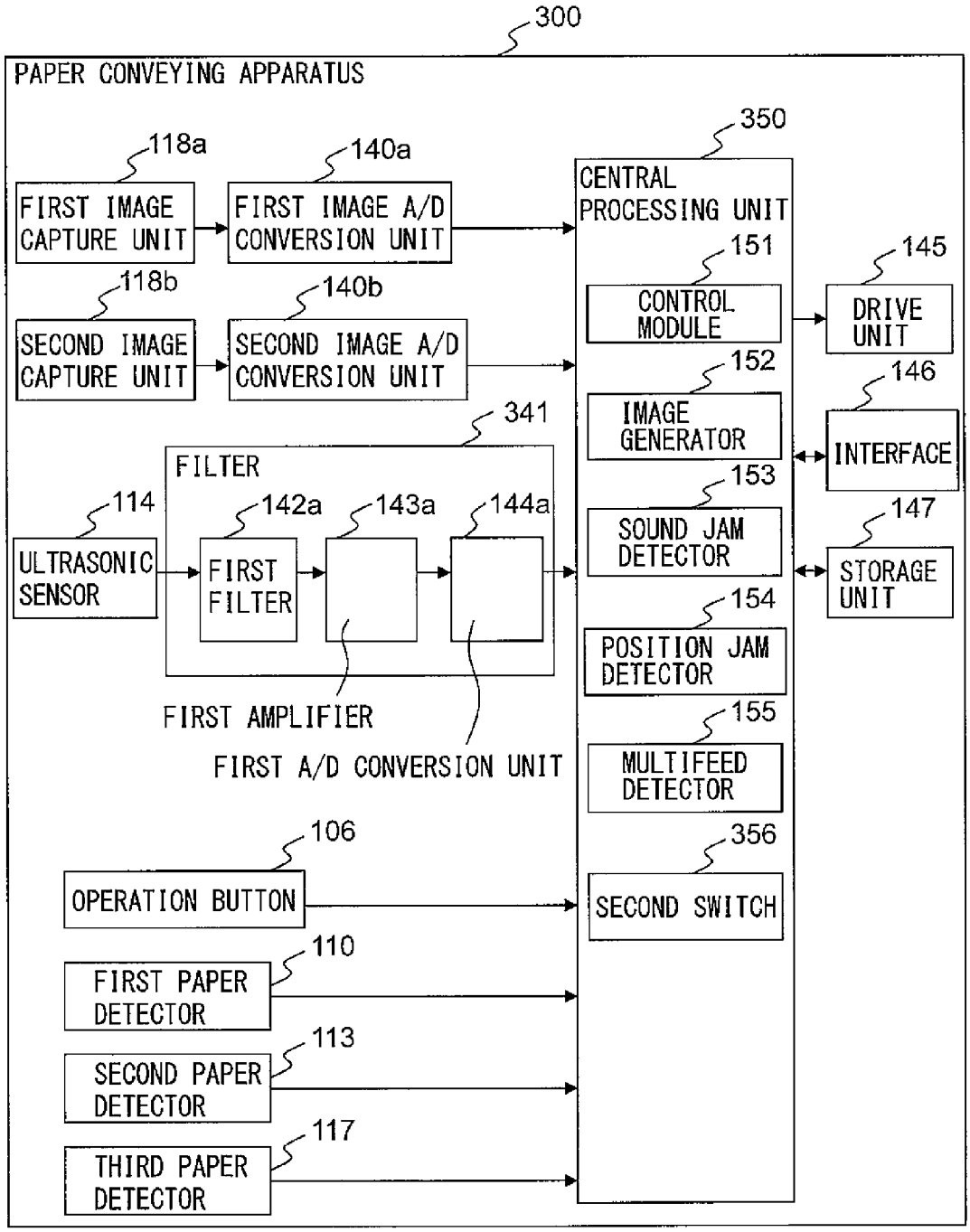
FIG. 16 is a block diagram which shows the schematic configuration of a paper conveying apparatus 300 according to still another embodiment.

FIG. 16 is a block diagram which shows the schematic configuration of a paper conveying apparatus 300 according to still another embodiment.

In the filter 341 of the paper conveying apparatus 300 which is shown in FIG. 16, among the parts of the filter 141 of the paper conveying apparatus 100 which is shown in FIG. 3, the second filter 142*b*, the second amplifier 143*b* and second A/D conversion unit 144*b* are omitted. Further, the central processing unit 350 of the paper conveying apparatus 300 has a second switch 356 in addition to the parts of the central processing unit 150 which is shown in FIG. 3.

The first filter 142*a* of the filter 341 is a bandpass filter which can set the pass band in real time. It passes a signal of a set frequency band in the analog ultrasonic signal which is output from the ultrasonic sensor 114 and outputs it to the first amplifier 143*a*.

The second switch 356 switches the frequency band which the first filter 142*a* is made to pass in accordance with the timing at which the ultrasonic transmitter 114*a* transmits an ultrasonic wave. The second switch 356 sets the first filter 142*a* so as to pass a first frequency while the ultrasonic transmitter 114*a* is transmitting an ultrasonic wave, and sets the first filter 142*a* so as to pass a second frequency while the ultrasonic transmitter 114*a* is not transmitting an ultrasonic wave.

The filter 341 outputs the first ultrasonic signal based on the component of the ultrasonic wave which the ultrasonic transmitter 114*a* transmits while the ultrasonic transmitter 114*a* is transmitting an ultrasonic wave and outputs the second ultrasonic signal based on the component due to the conveyance sound at the time of conveyance of the paper while the ultrasonic transmitter 114*a* is not transmitting an ultrasonic wave.

As explained above in detail, the paper conveying apparatus 200 switches the component of the frequency band which the first filter 142*a* is made to pass in accordance with the timing at which the ultrasonic transmitter 114*a* transmits an ultrasonic wave. Therefore, in the paper conveying apparatus 200, the numbers of the filters, amplifiers, and A/D conversion units can be reduced and therefore it becomes possible to determine the presence of a sound jam by a lower cost.

According to the paper conveying apparatus and the jam detection method, and the computer-readable, non-transitory medium, an ultrasonic signal for determining whether multifeed of papers has occurred is used to determine whether a jam has occurred, so it becomes possible to determine whether a jam has occurred based on the sound which is generated by paper during conveyance of the paper at a low cost.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A paper reading apparatus for reading an image from a paper comprising:

an ultrasonic transmitter provided near a conveyance path of the paper;

an ultrasonic receiver, provided opposed to the ultrasonic transmitter across the conveyance path, for outputting an ultrasonic signal;

a filter for separating a component of a first frequency band of an ultrasonic wave transmitted by the ultrasonic transmitter and passing through the paper, and a component of a second frequency band which is within an audible range and lower than the first frequency band of a sound of conveyance at the time of paper conveyance, from the ultrasonic signal;

a multifeed detector for determining whether multifeed of papers has occurred based on the component of the first frequency band;

a sound jam detector for determining whether a jam has occurred based on the component of the second frequency band; and a control module for performing an abnormal processing based on detection of a jam by the sound jam detector, wherein the control module determines that the jam has not occurred and does not perform the abnormal processing, when the sound jam detector determined that the jam has occurred and the multifeed detector determined that the multifeed has occurred.

2. The paper reading apparatus according to claim 1, wherein the filter includes a first filter for passing the component of the first frequency band in the ultrasonic signal, a second filter for passing the component of the second frequency band in the ultrasonic signal, and an amplifier for amplifying a signal which either of the first filter or the second filter outputs.

3. The paper reading apparatus according to claim 2, wherein the ultrasonic transmitter transmits the ultrasonic wave at a predetermined intervals, and further comprises a first switch for switching a signal to be amplified by the amplifier in accordance with the predetermined intervals.

4. The paper reading apparatus according to claim 1, wherein the filter passes either of the component of the first frequency band or the component of the second frequency band in the ultrasonic signal.

5. The paper reading apparatus according to claim 4, wherein the ultrasonic transmitter transmits the ultrasonic wave at a predetermined intervals, and further comprises a second switch for switching the component of the frequency band to be passed through the filter in accordance with the predetermined intervals.

6. A jam detection method in a paper reading apparatus for reading an image from a paper, the method comprising:

acquiring a component of a first frequency band of an ultrasonic wave transmitted by an ultrasonic transmitter and passing through the paper, and a component of a second frequency band which is within the audible range and lower than the first frequency band of a sound of conveyance at the time of paper conveyance, from a filter for separating the component of the first frequency band and the component of the second frequency band, wherein the ultrasonic transmitter is provided near a conveyance path of the paper and the ultrasonic receiver is provided opposed to the ultrasonic transmitter across the conveyance path;

determining whether multifeed of papers has occurred based on the component of the first frequency band;

determining whether a jam has occurred based on the component of the second frequency band; and performing, by a computer, an abnormal processing based on the determining whether a jam has occurred, wherein the computer determines that the jam has not occurred and does not perform the abnormal processing, when determining that the jam has occurred and determining that the multifeed has occurred.

7. A computer-readable, non-transitory medium storing a computer program, wherein the computer program causes a paper reading apparatus for reading an image from a paper to execute a process, the process comprising:

acquiring a component of a first frequency band of an ultrasonic wave transmitted by an ultrasonic transmitter and passing through the paper, and a component of a second frequency band which is within the audible range and lower than the first frequency band of a sound of conveyance at the time of paper conveyance, from a filter for separating the component of the first frequency band and the component of the second frequency band, wherein the ultrasonic transmitter is provided near a conveyance path of the paper and the ultrasonic receiver is provided opposed to the ultrasonic transmitter across the conveyance path;

determining whether multifeed of papers has occurred based on the component of the first frequency band;

determining whether a jam has occurred based on the component of the second frequency band; and performing an abnormal processing based on the determining whether a jam has occurred, wherein the computer determines that the jam has not occurred and does not perform the abnormal processing, when determining that the jam has occurred and determining that the multifeed has occurred.

8. The paper reading apparatus according to claim 1, wherein the audible range is a frequency band of 20 kHz to 300 kHz.

* * * * *